US006698392B1

(12) United States Patent
Köhnert et al.

(10) Patent No.: US 6,698,392 B1
(45) Date of Patent: Mar. 2, 2004

(54) SINGLE-PART COOLING CHANNEL PISTON FOR A COMBUSTION ENGINE

(75) Inventors: Hans-Jürgen Köhnert, Winnenden (DE); Peter Kemnitz, Leutenbach (DE)

(73) Assignee: Mahle GmbH, Stuttgart (DE)

( * ) Notice: Subject to any disclaimer, the term of this patent is extended or adjusted under 35 U.S.C. 154(b) by 0 days.

(21) Appl. No.: 10/270,256

(22) Filed: Oct. 11, 2002

(30) Foreign Application Priority Data

Sep. 25, 2002 (DE) ..... 102 44 510

(51) Int. Cl.[7] ..... F02F 3/22
(52) U.S. Cl. ..... 123/193.6
(58) Field of Search ..... 123/193.6; 92/186, 92/222, 216

(56) References Cited

U.S. PATENT DOCUMENTS 5,086,736 A * 2/1992 Wiemann ..... 123/193.6
5,144,884 A * 9/1992 Kelly ..... 92/186
5,778,533 A * 7/1998 Kemnitz ..... 123/193.6
6,286,414 B1 * 9/2001 Kruse ..... 92/186

FOREIGN PATENT DOCUMENTS

DE 100 13 395 8/2001
EP 0 799 373 10/1997

* cited by examiner

*Primary Examiner*—Marguerite McMahon
(74) *Attorney, Agent, or Firm*—Collard & Roe, P.C.

(57) ABSTRACT

A single-part cooling channel piston for a combustion engine with a piston head of forged steel comprises a combustion bowl in the piston crown, a ring wall with ring belt and an all-round closed cooling channel level with the ring belt. The piston skirt is connected to the pin bosses attached to the piston head. Inexpensive manufacture together with improved cooling and good form stability of the piston is achieved by providing the cooling channel with holes spread over its circumference towards the piston crown and spaced such that the piston material present between such holes forms supporting ribs for the piston crown.

7 Claims, 1 Drawing Sheet

SINGLE-PART COOLING CHANNEL PISTON FOR A COMBUSTION ENGINE

BACKGROUND OF THE INVENTION

1. Field of the Invention

The invention relates to a single-part cooling channel piston for a combustion engine with a piston head of forged steel, comprising a combustion bowl in the piston crown, a ring wall with a ring belt and an all-round closed cooling channel level with the ring belt. The piston skirt is connected to the pin bosses attached to the piston head.

2. The Prior Art

Generic single-part cooling channel pistons are known for example from European Patent No. EP 0 799 373 B1 or DE 100 13 395 C1. In the cooling channel pistons described therein, a piston blank is manufactured by forging an annular recess and the cooling channel, open to the bottom, is provided by metal-cutting machining methods, and then the outer contour of the piston is finish-machined. The axial height of the annular recess corresponds in EP 0 799 373 B1 at least to the axial height of the cooling channel. This is necessary since a hook-like turning tool is inserted into the recess for manufacture of the cooling channel open to the bottom and the cooling channel must be hollowed out into its required form by appropriate axial and radial infeed.

The drawback with these pistons is that the height of the hook-like turning tool determines the achievable cooling channel height and hence the quantity of heat to be dissipated from the piston crown as a consequence of high wall thicknesses. To increase the cooling channel height or to reduce the wall thickness between the cooling channel and the piston crown, the recess for insertion of the turning tool would have to be increased, which would however entail an unwelcome increase in the height of the piston.

On the other hand, the piston stability would decrease as a result of the aforementioned reduced wall thickness. Therefore, the above manufacturing methods and piston designs are not suitable for improvement of the piston with respect to its height or its stability for the high ignition pressures and temperatures as encountered in modern diesel engines.

SUMMARY OF THE INVENTION

It is therefore an object of the present invention to provide an improved piston concept for a single-part cooling channel piston with which inexpensive manufacture of a low-height piston is assured and with which piston deformation due to the effects of high gas pressures and temperatures can be effectively countered.

This object is achieved by piston having a cooling channel formed in the piston head with holes spread over its circumference towards the piston crown, with the holes spaced such that the piston material present between such holes forms supporting ribs for the piston crown.

With a piston manufactured in this way, at least part of the cooling channel can be formed closer towards the piston crown or combustion bowl and nevertheless has excellent form stability plus a low piston height. In addition, the arrangement of the supporting ribs effects a kind of chamber formation inside the cooling channel, i.e. creates shaker areas, whereby a prolongation of the dwell time of the cooling oil is achieved and hence an improved heat dissipation of the piston areas to be cooled. In particular, the cooling effect can be further improved by a higher number of holes in those areas of the cooling channel in which the combustion radiation impacts the piston crown.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
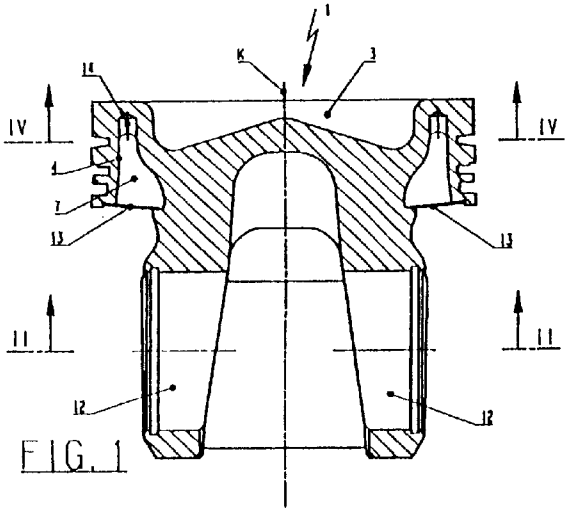
FIG. 1 shows a piston in accordance with the invention in a cross-section in the pin direction.
Figure 2:
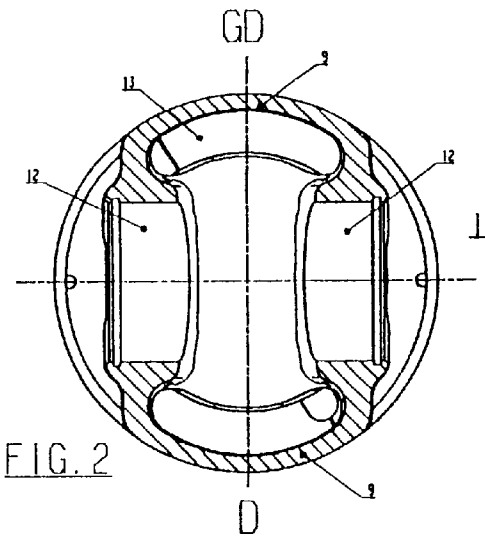
FIG. 2 shows a piston in accordance with the invention from below, in a section along the line II in accordance with FIG. 1.

Referring now in detail to the drawings, the single-part cooling channel piston in accordance with the invention comprises a piston head 1 of forged steel or forgeable aluminum alloy with a combustion bowl 3 in its piston crown 2, a ring wall 4 with ring belt 11, and an all-round closed cooling channel 7 level with the ring belt 11, where a piston skirt 9 is connected to the pin bosses 12 attached to the piston head 1. The manufacture of the piston is in accordance with EP 0 799 373 B1, where prior to the closure of the cooling channel 7 by means of a cover 13, holes 14 are provided in accordance with the embodiment in the cooling channel 7 that are arranged symmetrically spread over the circumference and are positioned in the direction of the piston crown, i.e. parallel to the longitudinal piston axis K. The depth $h_B$ of the holes 14 is not more than a quarter of the total height H of the cooling channel 7, so that an unhindered circulation of cooling oil remains assured. Due to this design, shaker areas are created for the cooling oil which increase the cooling effect.

The cooling oil inlet 5 and the cooling oil outlet 10 are arranged opposite to one another in a cooling channel cover 13 comprising a two-part spring element. The cooling channel 7 is closed at its end open to the piston crown 9 by the cooling channel cover 13.

Figure 3:
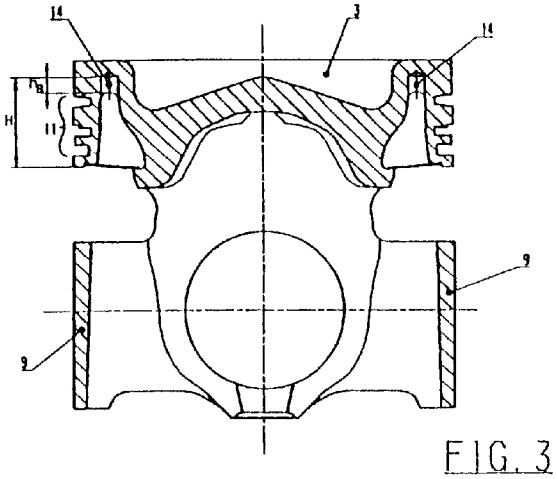
FIG. 3 shows a piston in accordance with the invention, in a cross-section transverse to the piston pin direction.
Figure 4:
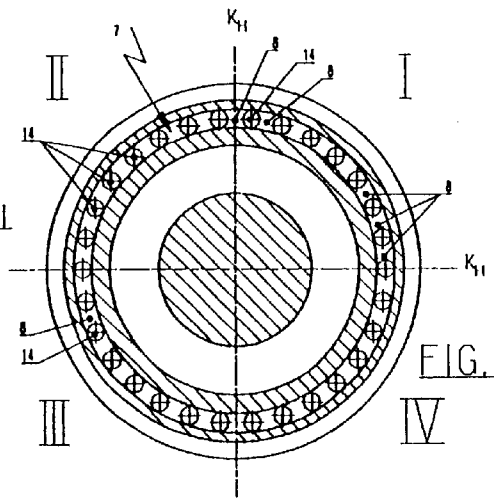
FIG. 4 shows a piston in accordance with the invention, in a section along the line IV—IV in FIG. 1.
Figure 5:
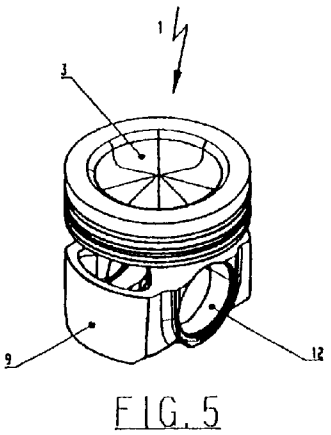
FIG. 5 shows a piston in accordance with the invention, in a perspective view.

As shown in FIGS. 3 and 4, the material areas between the holes 14 form supporting ribs 8 whose width is determined by the spacing of the holes 14. The holes 14 are spaced in the cooling channel 7 on the circumferential side such that the spacing corresponds to at least half the diameter of the holes 14, with the hole diameters all being identical. It is of course at the discretion of the person skilled in the art to use different hole diameters too, with the spacing then corresponding to half the largest hole diameter in order to counter any piston deformation during engine operation.

The holes 14 and hence the supporting ribs 8 are, as shown in FIG. 4, arranged radially symmetrically over the circumference of the cooling channel 7. In a further embodiment (not shown), the number of holes 14 and hence the spread of the supporting ribs 8 can be such that in the major/minor thrust direction D or GD a larger number of supporting ribs 8 is arranged than transversely thereto, i.e., a non-symmetrical spread in the cooling channel 7 is achieved on the circumferential side. In this way, the spread of the holes 14 and hence of the supporting ribs 8 in the cooling channel 7 can, if the latter is characterized by the quadrants I–IV formed by the main piston axes $K_H$, be such that within a quadrant a symmetrical (FIG. 4) or non-symmetrical or partially symmetrical spread (FIG. 6) is achieved, or the spread is dependent on the local temperature distribution in the piston crown. In particular, the cooling effect can be further improved by a higher number of holes in those areas of the cooling channel 7 in which the combustion radiation from the ignited fuel impacts the piston crown 2. As a result, in the event of loading the tension strains of the piston can also be better countered.

Figure 6:
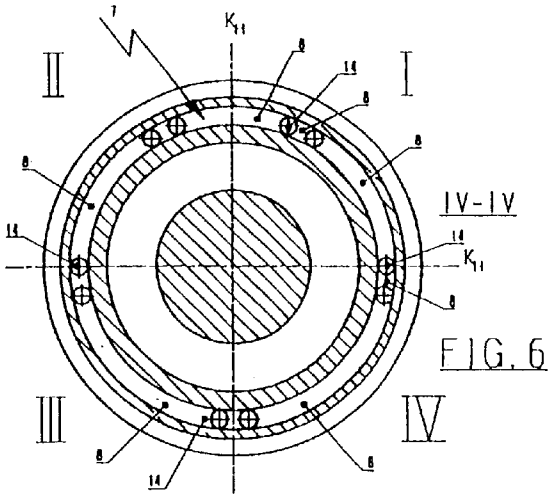
FIG. 6 shows a piston in accordance with the invention, in a section along the line IV—IV in FIG. 1, in a further embodiment.

The holes 14 can be designed as round holes, as shown in FIGS. 4 and 6, or as elongated holes (not shown) whose long sides face radially outwards from the piston center to the piston wall. With these respective embodiments of the hole arrangements, it is achieved that the holes have different spacings and hence the material designed as supporting ribs 8 is increased. Crucial for the spacing of the holes is that the distance from hole axis to hole axis corresponds on the circumferential side to at least half the largest hole diameter used.

For further influence on the heat dissipation from the combustion bowl 3, the ends of the holes 14 can be round or, as shown in FIG. 1, angular.

The axes of the holes 14 can, as shown in FIG. 1, be arranged parallel to the longitudinal piston axis K and/or, i.e. in combination, at an acute angle thereto, with the holes preferably pointing in the direction of the piston crown 2 or combustion bowl 3.

Accordingly, while only a few embodiments of the present invention have been shown and described, it is obvious that many changes and modifications may be made thereunto without departing from the spirit and scope of the invention.

What is claimed is:

1. A single-part cooling channel piston for a combustion engine, comprising;

a piston head of forged steel, said piston head comprising a combustion bowl in a piston crown, a ring wall with a ring belts and an all-round closed cooling channel level with the ring bell, and a piston skirt connected to pin bosses attached to the piston head, wherein the cooling channel has holes spread in areas in which combustion radiation from ignited fuel impacts the piston crown, said holes being arranged over a circumference of the cooling channel towards the piston crown, said holes being spaced depending on a temperature distribution of said areas caused by the combustion radiation such that piston material present between said holes forms supporting ribs for the piston crown.

2. A piston according to claim 1, wherein the holes are arranged symmetrically spread over the circumference of the cooling channel.

3. A piston according to claim 1, wherein the spacing of the holes on the circumference of the cooling channel is at least half a diameter of the hole.

4. A piston according to claim 5, wherein the holes are of the same diameter as each other.

5. A piston according to claim 1, wherein the holes are of a depth ($h_u$) which is no more than a quarter of a total height (H) of the cooling channel.

6. A piston according to claim 1, wherein the holes have axes and wherein at least part of the axes of the holes run parallel to a longitudinal piston axis (K).

7. A piston according to claim 1, wherein the holes (14) have a cylindrical or elongated form.

* * * * *